US011628450B2

(12) United States Patent
Wey et al.

(10) Patent No.: US 11,628,450 B2
(45) Date of Patent: Apr. 18, 2023

(54) TRAMP METAL REMOVING DEVICE

(71) Applicant: TAI HAN EQUIPMENT ENTERPRISE CO., LTD., Taipei (TW)

(72) Inventors: Shyh-Yi Wey, Taipei (TW); Wen-Cheng Chang, Taipei (TW); Kuen Ting Hsieh, Taipei (TW); Ken-Der Lin, Taipei (TW); Bao-Ding Li, Taipei (TW); Rong-Huei Wang, Taipei (TW); Jia-Ying Hong, Taipei (TW); Fu-Chen Wang, Taipei (TW); Ho-Chi Kang, Taipei (TW)

(73) Assignee: TAI HAN EQUIPMENT ENTERPRISE CO., LTD., Taipei (TW)

( * ) Notice: Subject to any disclaimer, the term of this patent is extended or adjusted under 35 U.S.C. 154(b) by 36 days.

(21) Appl. No.: 17/319,874

(22) Filed: May 13, 2021

(65) Prior Publication Data

US 2022/0048043 A1 Feb. 17, 2022

(30) Foreign Application Priority Data

Aug. 12, 2020 (TW) ..... 109127303

(51) Int. Cl.
*B03C 1/033* (2006.01)
*B03C 1/28* (2006.01)
(Continued)

(52) U.S. Cl.
CPC ..... *B03C 1/26* (2013.01); *B03C 2201/20* (2013.01); *B03C 2201/28* (2013.01)

(58) Field of Classification Search
CPC ..... B03C 1/032; B03C 1/284; B03C 2201/28
(Continued)

(56) References Cited

U.S. PATENT DOCUMENTS 4,867,869 A 9/1989 Barrett
6,902,066 B2 6/2005 Yang
(Continued)

FOREIGN PATENT DOCUMENTS

CN 107866332 A * 4/2018 ..... B03C 1/02
JP 2012192304 A * 10/2012 ..... B03C 1/26

OTHER PUBLICATIONS

Takahiko; Busshu, "Rod-Shaped Magnet Having Inclined Yoke Arrangement Structure and Magnetic Separator Using the Rod-Shaped Magnet" (English Translation), Oct. 11, 2012, worldwide.espacenet.com (Year: 2012).*
(Continued)

*Primary Examiner* — Michael McCullough
*Assistant Examiner* — Molly K Devine
(74) *Attorney, Agent, or Firm* — Birch, Stewart, Kolasch & Birch, LLP

(57) ABSTRACT

A tramp metal removing device has a primary housing to define a product flow path for being passed by a stream of raw materials and a moving path. A secondary housing is connected to the primary housing. A plurality of drawer units are sequentially stacked on the primary housing and secondary housing. Each drawer unit has a frame, a plurality of magnetic members and a scraping assembly. The frame is coupled with the primary and secondary housings in a movable way. Each of magnetic members is secured on the frame and has a magnetic section and a non-magnetic section. The scraping assembly is coupled with the frame in a way that it is only moveable in the secondary housing for removing tramp metals of a stream of raw materials in a two-stage manner.

6 Claims, 12 Drawing Sheets

(51) Int. Cl.
*B03C 1/02* (2006.01)
*B08B 1/00* (2006.01)
*B03C 1/26* (2006.01)

(58) Field of Classification Search
USPC ..... 209/229
See application file for complete search history.

(56) References Cited

U.S. PATENT DOCUMENTS

| | | | | |
|---|---|---|---|---|
| 8,132,674 | B1 * | 3/2012 | Allore | B03C 1/0332 209/229 |
| 2003/0173264 | A1 * | 9/2003 | Yang | B03C 1/284 210/695 |
| 2019/0046993 | A1 * | 2/2019 | Kwasniewicz | B03C 1/286 |

OTHER PUBLICATIONS

Li; Mingqiu, "Device for Removing Scrap Iron from Edible Crop Debris" (English Translation), Apr. 3, 2018, worldwide.espacenet.com (Year: 2018).*

* cited by examiner

TRAMP METAL REMOVING DEVICE

BACKGROUND OF THE INVENTION

1. Field of the Invention

The present invention relates to devices for removing tramp metals from a stream of raw materials, and more particularly to a tramp metal removing device that can scrape off tramp metals in a two-stage manner.

2. Description of the Related Art

A conventional device for removing tramp metals from a stream of raw materials is disclosed in U.S. Pat. No. 4,867,869. The device includes a duct, a frame removably housed within the duct and a plurality of non-magnetic tubes supported by the frame and extending across an opening in the frame. Each of the tubes removably houses a magnet. The magnets can be pulled out of the tubes in order to remove tramp metals from the exterior of the tubes. A disadvantage of this device is that tramp metals in a stream of raw materials are not directly attached to the magnets thereof, so the tramp metals cannot be effectively removed from the stream of raw materials. And another disadvantage of this device is that the tramp metals attached on the exterior of the tubes are separated from the exterior of the tubes only in an automatic way, so there is still a small amount of the tramp metals remained on the exterior of the tubes.

Another conventional device for removing tramp metals from a stream of raw materials is disclosed in U.S. Pat. No. 6,902,066. The device named a removal unit for metal alien removal apparatus includes a body and a removal unit coupled to the body in a way that it can be inserted into or pulled out the body. The removal unit includes a plurality of magnet members and a removal member arranged to be slidable along the magnet members while being in contact with the outer peripheral surfaces of the magnet members. Each of the magnet members includes a cylindrical stainless steel rod, a magnet received in one end of the cylindrical stainless steel rod and a non-magnetic piece received respectively in the other end of the cylindrical stainless steel rod. A disadvantage of this device is that, as shown in FIGS. 5B and 5C of the patent, as the removal member is used to wipe the metallic alien materials attached to the outer peripheral surface of each stainless steel rod, it must slide from one end of the stainless steel rod toward the other end of the stainless steel rod in which the non-magnetic piece is received. In other words, when the removal member is to wipe the metallic alien materials attached to the outer peripheral surface of each stainless steel rod, the sliding distance of the removal member is almost equal to the whole length of stainless steel rod. Such an operation is not only laborious but also time-consuming.

Thus, it is need to configure a tramp metal removing device to overcome the disadvantages mentioned above.

SUMMARY OF THE INVENTION

Disclosed herein is a tramp metal removing device comprising a primary housing, a secondary housing and a plurality of drawer units. The primary housing includes an upper inlet, a bottom outlet opposite the upper inlet and a first internal space disposed between the upper inlet and the bottom outlet to define a product flow path through which a stream of raw materials may pass. The first internal space also defines a moving path and has a first length in the direction of the moving path. The secondary housing is connected to the first housing and includes a second internal space adjacent to the first internal space. The second internal space has a second length shorter than the first length in the direction of the moving path. The drawer units are sequentially stacked on the primary housing and the secondary housing. Each of the drawer units comprises a frame, a plurality of magnetic members and a scraping assembly. The frame is coupled with the primary housing and the secondary housing in a way that it is moveable in the moving path between a retracted, passaged and extended positions. Each of the magnetic members has a magnetic section, a non-magnetic section and a third length shorter than the first length but longer than the second length and is secured on the frame in a way that when the frame is in the retracted position, each of the magnetic members is received in the first internal space and adapted to be in contact with a stream of raw materials, when the frame is moved from the retracted position to the passaged position, the magnetic members are moved a first distance to be in a state that a portion of each of the magnetic members is positioned outside the first internal space and the other portion thereof is received within the first internal space, and when the frame is moved from the passaged position to the extended position, the magnetic members are moved a second distance to be in a state that a portion of each of the magnetic members is positioned outside the second internal space and the other portion thereof including the non-magnetic section is received within the second internal space. The scraping assembly is coupled with each of magnetic members and the frame in a way that when the frame is located on the retracted position, the scraping assembly is received and located in one side of the second internal space, when the frame is moved from the retracted position to the passaged position, the scraping assembly is moved synchronously with the frame to be located in the other side of the second internal space for removing tramp metals from the portion of each of the magnetic members positioned outside the second internal space to the other portion of each of the magnetic members received within the second internal space as the frame is continuously moved in the moving path, and when the frame is moved from the passaged position to the extended position, the scraping assembly is still located in the other side of the second internal space for removing tramp metals from the magnetic section of each of the magnetic members to the non-magnetic section of each of the magnetic members to discharge tramp metals as the scraping assembly is moved relative to each of magnetic members in a direction opposite to the moving path.

In this way, the tramp metal removing device disclosed provides the advantage of the sliding distance of the scraping assembly for removing tramp metals attached to the magnetic members being shorten and thereby resulting in not only labor-saving but also time-saving.

The frame of the tramp metal separation device may include a front plate, a rear plate opposite the front plate, a face plate opposite the front plate, a pair of guiding rods, and at least a connecting rod. Each of the guiding rods has a fourth length in the direction of the moving path and longer than the third length and is coupled between the face and rear plates in a way that one of the guiding rods is coupled at a first end thereof to one side of the face plate and at a second end thereof to one side of the rear plate, and the other one of the guiding rods is coupled at a first end thereof to the other side of the face plate and at a second end thereof to the other side of the rear plate. The at least connecting rod is coupled between the front and face plates in a way that a front end thereof is coupled to the front plate and a rear end thereof is coupled to the face plate.

Each of the magnetic members may include a non-magnetic rod, a magnetic set and a non-magnetic element. The non-magnetic rod has a proximal end coupled to the front plate and a distal end coupled to the rear plate. The magnetic set is received within the non-magnetic rod and extends from the proximal end of the non-magnetic rod to at least a middle portion of non-magnetic rod for forming the magnetic section. The non-magnetic element is received within the distal end of the non-magnetic rod and extends from the distal end to abut to the magnetic set for forming the non-magnetic section.

The scraping assembly may comprise a base plate and a first scraper. The base plate is coupled with the guiding rods and includes a window. The first scraper is made of a first material with a predetermined hardness, secured on one side of the base plate, and having a plurality of first apertures arranged in an area thereof corresponding the window for being passed through by each of the magnetic members respectively wherein the inner peripheral surface of each of the first apertures is in close contact with the outer peripheral surface of an associated one of the magnetic members.

The scraping assembly may further comprise a second scraper made of a second material with a hardness less than that of the first material, secured on the other side of the base plate, and having a plurality of second apertures arranged in an area corresponding the window for being passed through by each of the magnetic members respectively wherein each of the second apertures has an inner diameter smaller than the outer diameter of the non-magnetic rod to form an interference fit therebetween.

The primary housing may further comprise a first entrance from which each of the drawer units is pushed into or pulled out the first internal space of the primary housing, two first support plates respectively disposed on each side of the first entrance through which the guiding rods of each of the frames pass so that each of the frames can be moved independently along the moving path between the retracted, passaged position and extended positions.

The secondary housing may further comprise two side walls defining the second internal space with a second entrance so that a portion of each of the drawer units can be pushed into or pulled out the second internal space from the second entrance, and two second support plates respectively disposed on each side of the second entrance through which the guiding rods of each of the frames pass.

Each of the side walls of the secondary housing may comprise a plurality of guiding slots spaced apart from each other and having a predetermined length in the direction of the moving path to define the second distance, and the scraping assembly may further comprise a pair of guiding bars extending outwardly from each of the guiding slots to which each of the guiding bars corresponds so that the scraping assembly can be moved along the guiding slots.

The tramp metal removing device may also comprise at least a mechanical latch for selectively locking the drawer unit in a closed position with respect to the secondary housing.

BRIEF DESCRIPTION OF THE DRAWINGS

The above, as well as other advantages of the present invention will become readily apparent to those skilled in the art from the following detailed description when considered in the light of the accompanying drawings in which.

DETAILED DESCRIPTION OF THE INVENTION

Figure 1:
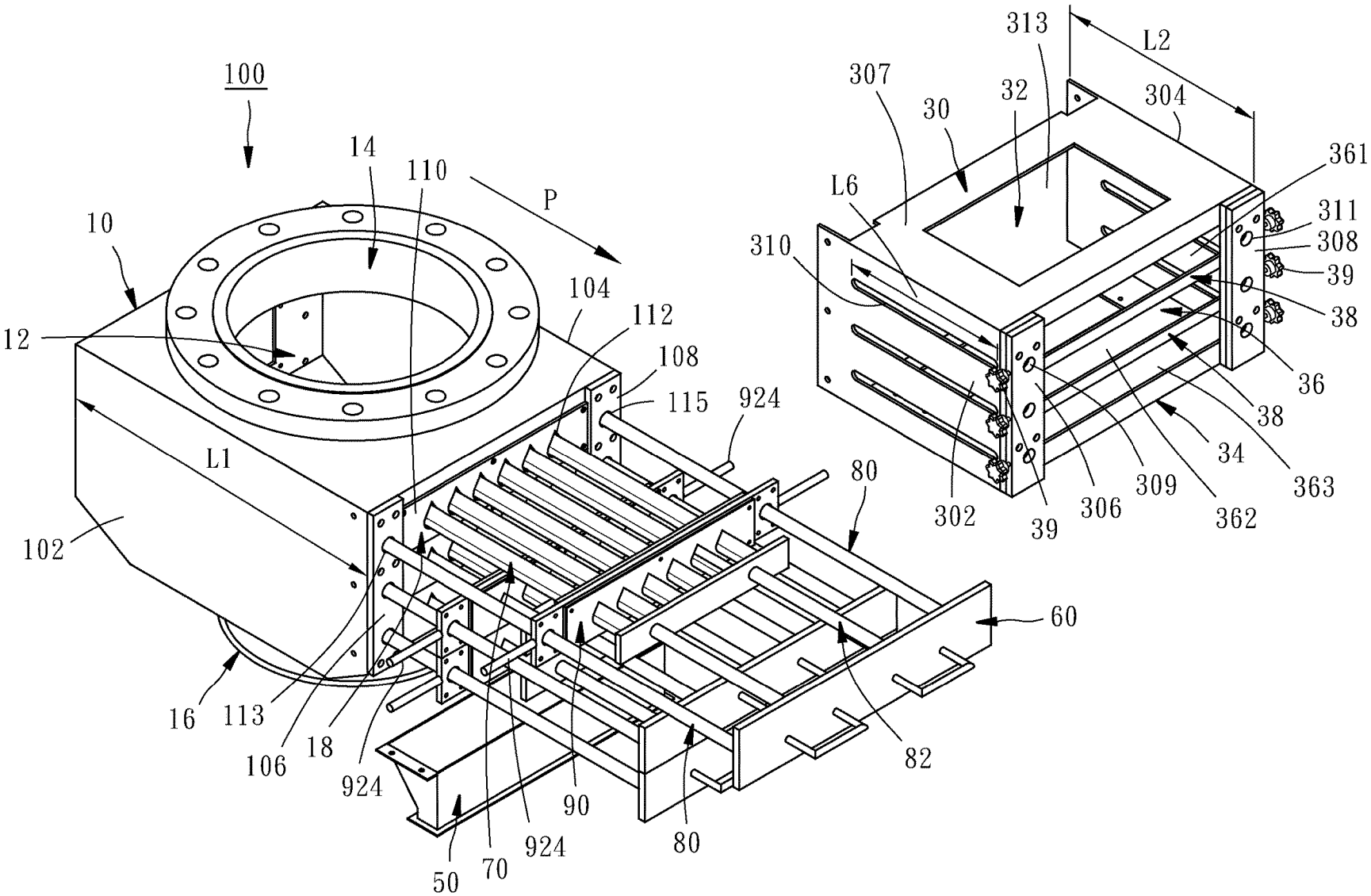
FIG. 1 is a partially exploded perspective view of a tramp metal removing device according to a first preferred embodiment of the present invention.

Referring firstly to FIG. 1, it shows a tramp metal removing device 100 configured according to a first preferred embodiment of the present invention. The tramp metal removing device 100 comprises a primary housing 10, a secondary housing 30 connected to the primary housing 10, a collector 50 disposed under secondary housing 30, and three drawer units 60 respectively arranged within the primary housing 10 and secondary housing 30 in a sequentially stacked manner.

The primary housing 10 includes a pair of first side walls 102 and 104, a pair of first supporting plates 106 and 108 and a stopping plate 110. The first side walls 102 and 104 are combined to define an upper inlet 14, a bottom outlet 16 opposite the upper inlet 14 and a first internal space 12 between the upper inlet 14 and the bottom outlet 16. The first internal space 12 defines a product flow path through which a stream of raw materials may pass, a moving path P perpendicular to the product flow path, a first length L1 in the direction of the moving path P and a first entrance 18. The stopping plate 110 is disposed on the first entrance 18. Each of the first supporting plates 106 and 108 is respectively secured on the left and right sides of the stopping plate 110.

The secondary housing 30 includes a pair of second side walls 302 and 304, a pair of second supporting plates 306 and 308 and an upper plate 307. The second side walls 302, 304 and the upper plate 307 are combined to define a second internal space 32 with a second length L2 in the direction of the moving path P, a collecting opening 34 located above the collector 50 and a second entrance 36. The second internal space 32 is adjacent to the first internal space 12 in the direction of the moving path P. The second length L2 is shorter than the first length L1 of the first internal space 32. The secondary housing 30 further includes two cross bars 38 fixed to the second supporting plates 306 and 308 respectively in a way that the second entrance 36 is divided into three exits 361, 362 and 363 so that each of the drawer units 60 can be pushed into or pulled out the second internal space 32 independently. The upper plate 307 has a top opening 313 so that the operator can view into the second internal space 32 therefrom.

Figure 2:
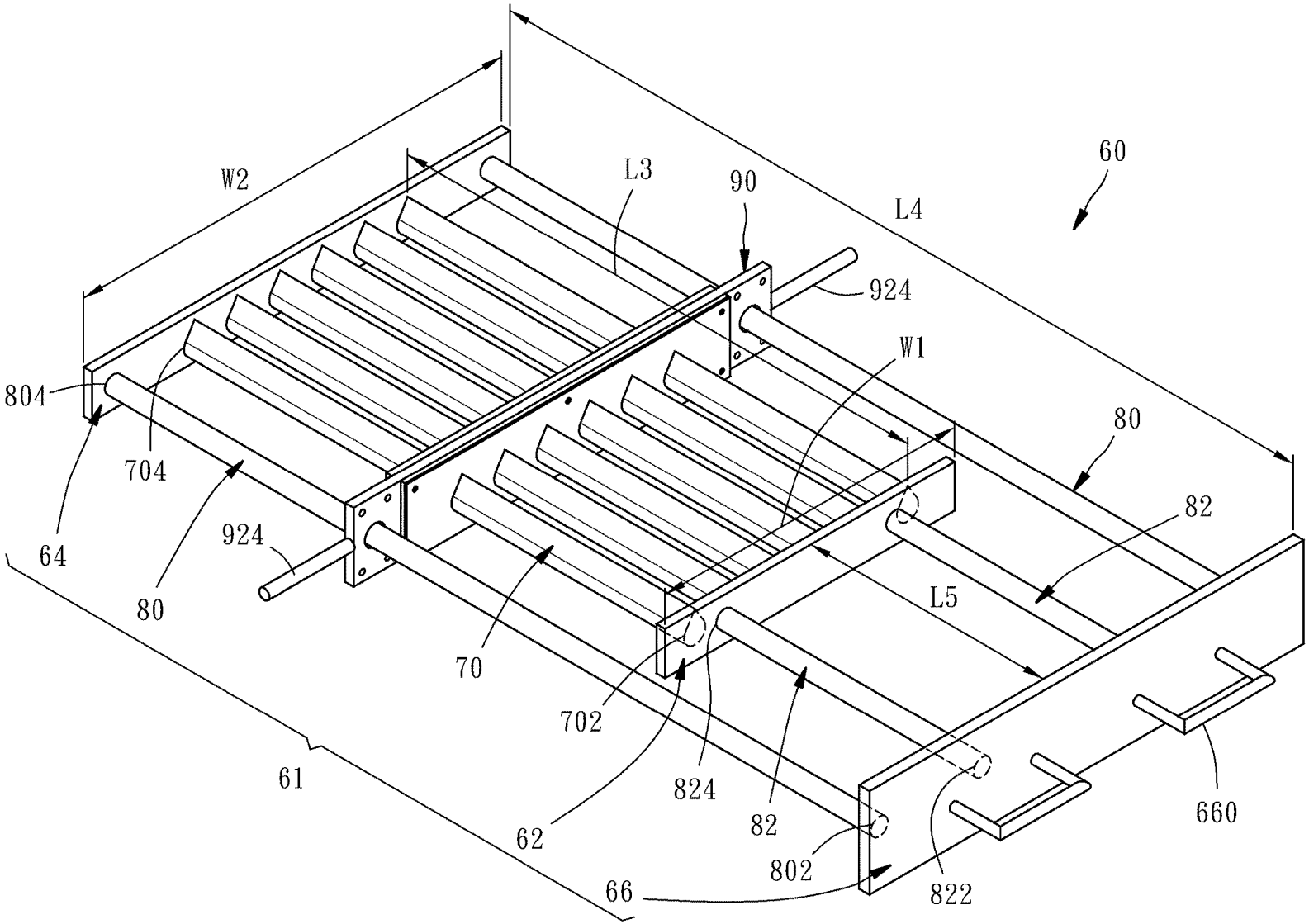
FIG. 2 is a perspective view of a drawer unit of the first preferred embodiment shown in FIG. 1.
Figure 3:
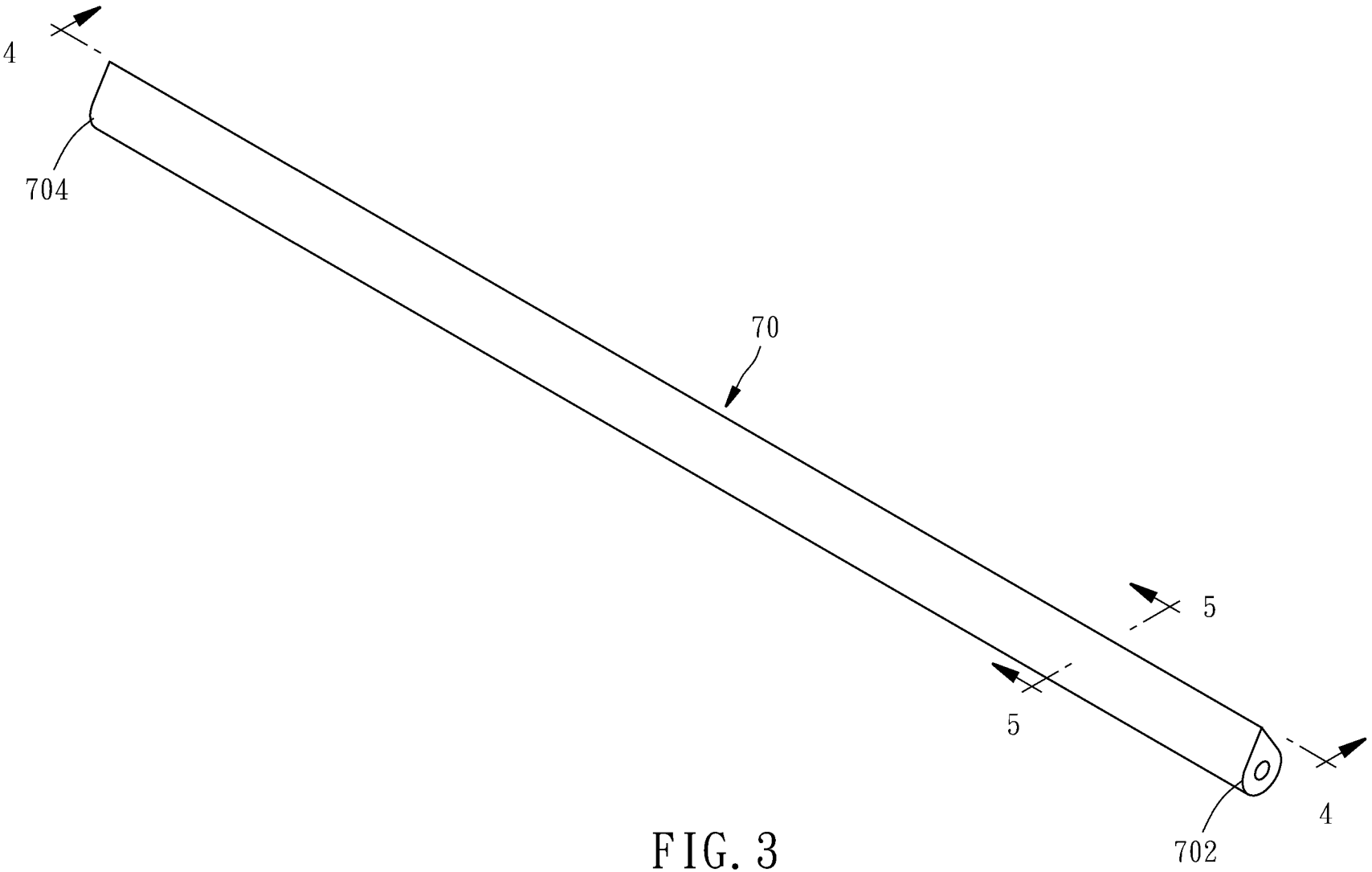
FIG. 3 is a perspective view of a magnetic member of the first preferred embodiment shown in FIG. 1.
Figure 4:
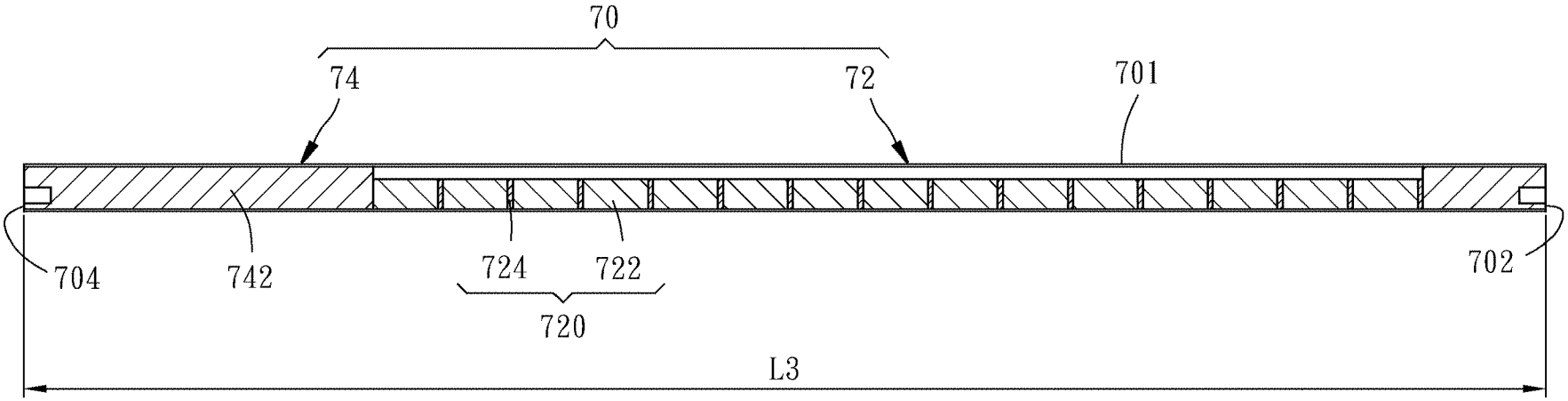
FIG. 4 is a longitudinal sectional view taken along the direction 4-4 of FIG. 3.
Figure 5:
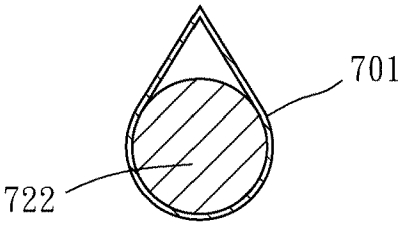
FIG. 5 is a longitudinal sectional view taken along the direction 5-5 of FIG. 3.

Next, referring to FIG. 2, each of the drawer unit 60 comprises a frame 61, six magnetic members 70 and a scraping assembly 90.

The frame 61 includes a front plate 62, a rear plate 64, a face plate 66 and a pair of guiding rods 80. The front plate 62 has a first width W1 defining a first range for fixing one end of each of the magnetic members 70. The rear plate 64 has a second width W2 that is longer than the first width W1 for fixing the other end of each of the magnetic members 70 in a second range opposite to the first range and reserving two edges thereof for fixing one end of each guiding rods 80 respectively. The front and rear plates 62 and 64 are spaced apart from each other by a desired distance. The magnetic members 70 are coupled between the front and rear plates 62 and 64 in a way that each of them is spaced apart and horizontally side by side with one end thereof fixed to the front plate 62 and the other end fixed to the rear plate 64.

Each of the magnetic members 70, as shown in FIGS. 2-5, includes a non-magnetic rod 701, a magnetic set 720 and a non-magnetic element 742. The non-magnetic rod 701 has a third length L3 in the direction of the moving path P, a proximal end 702 coupled to the front plate 62 and a distal end 704 coupled to the rear plate 64. In this embodiment, the non-magnetic rod 701 has a drop-shaped cross section for reducing the accumulation of raw materials. The magnetic set 720 includes a plurality of magnets 722 and a plurality of spacers 724 respectively disposed between the two adjacent magnets 722. The magnetic set 720 is received in the non-magnetic rod 701 and extends from the proximal end 702 of the non-magnetic rod 701 to at least a middle portion of the non-magnetic rod 701 for forming a magnetic section 72. The non-magnetic element 742 is received in the distal end 704 of the non-magnetic rod 701 and extends from the distal end 704 to abut to the magnetic set 720 for forming a non-magnetic section 74. Preferably, the third length L3 of the non-magnetic rod 701 is shorter than the first length L1 of the first internal space 12 but longer than the second length L2 of the second internal space 32.

Each of the guiding rods 80, as shown in FIG. 2, has a fourth length L4 longer than the third length L3 of the non-magnetic rod 701 and coupled between the face and rear plates 66 and 64 in a way that one of the guiding rods 80 is coupled at a first end 802 thereof to one side of the face plate 66 and at a second end 804 thereof to one side of the rear plate 64, and the other one of the guiding rods 80 is coupled at a first end 802 thereof to the other side of the face plate 66 and at a second end 804 thereof to the other side of the rear plate 64.

In this embodiment, for enabling the magnetic members 70 to be moved stably, the frame 61 further includes a pair of connecting rods 82 having a fifth length L5 approximately equal to the second length L2 of the secondary housing and coupled between the front and face plates 62 and 66 respectively in a way that a front end 822 of each of the connecting rods 82 is coupled to the face plate 66 and a rear end 824 of each of the connecting rods 82 is coupled to the front plate 62.

Figure 6:
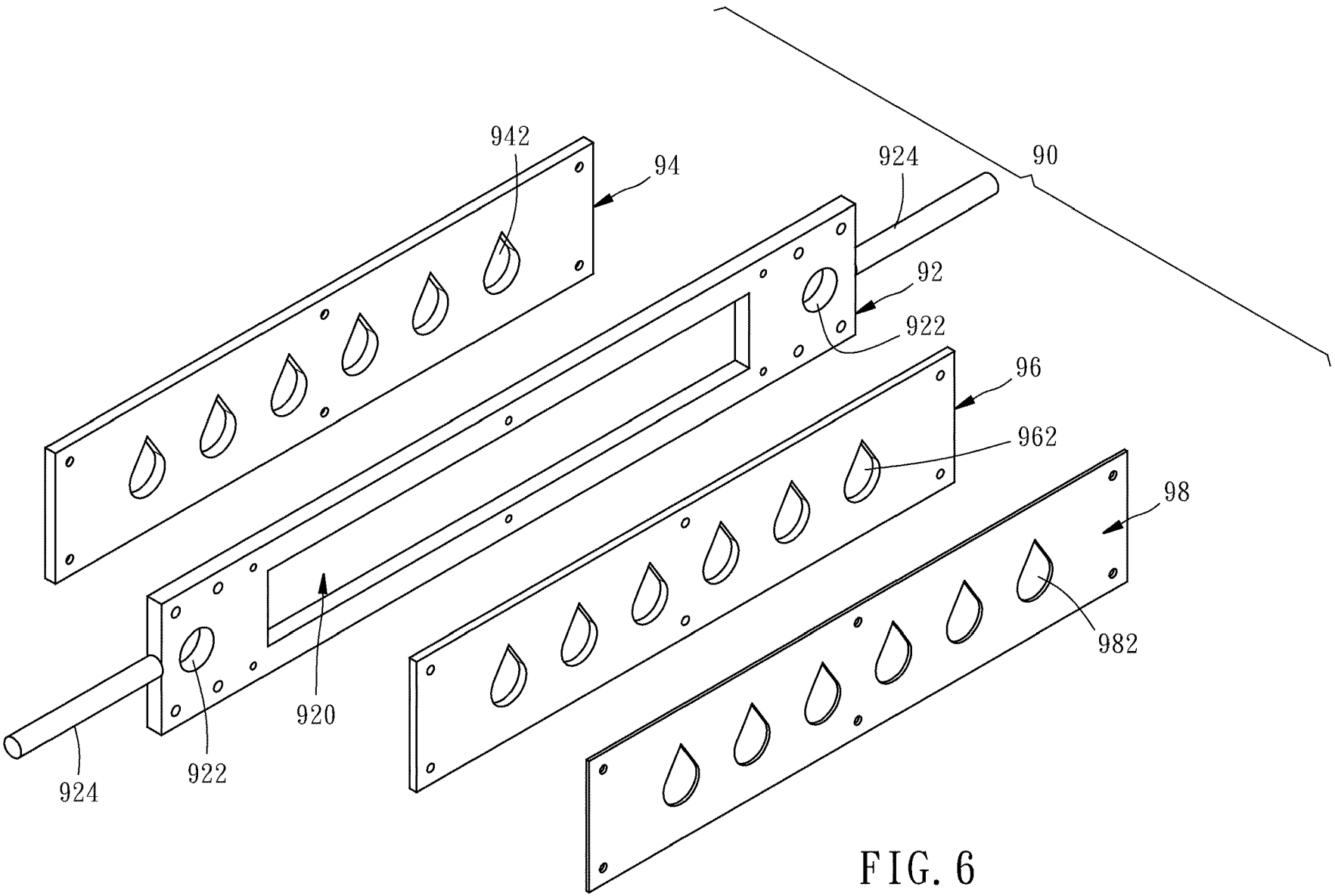
FIG. 6 is an exploded perspective view of a scraping assembly of the drawer unit shown in FIG. 2.

The scraping assembly 90 is disposed in the second internal space 32 of the secondary housing 30 and arranged to be slidable along the longitudinal direction of the non-magnetic rods 701 while being in contact with the outer peripheral surface of each of the non-magnetic rods 701. In this embodiment, as shown in FIG. 6, the scraping assembly is specially designed as described below.

The scraping assembly 90 comprises a base plate 92, a first scraper 94, a second scraper 96 and an emplacing plate 98. The base plate 92 includes a window 920 and two through holes 922 respectively located on each end thereof for being passed through by the guiding rods 80. The first scraper 94 is made of a first material with a predetermined hardness, such as Mono Cast Nylon, and secured on one side of the base plate 92. The first scraper 94 has a plurality of first apertures 942 arranged in an area thereof corresponding the window 920 for being passed through by the magnetic members 70 respectively wherein the inner peripheral surface of each first aperture 942 is in close contact with the outer peripheral surface of an associated one of the magnetic members 70. The second scraper 96 is made of a second material with a hardness less than that of the first material, such as silicone rubber and secured on the other side of the base plate 92. The second scraper 96 also has a plurality of second apertures 962 also arranged in an area corresponding the window 920 for being passed through by the magnetic members 70 respectively. In this embodiment, each second aperture 962 has an inner diameter smaller than the outer diameter of the non-magnetic rod 701, resulting in an interference fit therebetween that will further aid in totally and reliably scraping tramp metals. The emplacing plate 98 has a plurality of third apertures 982 opposite to the second apertures 962, and is secured on the base plate 92 in a manner that the second scraper 96 is emplaced between the base plate 92 and the emplacing plate 98 for being passed through by the non-magnetic rods 70 stably and tightly.

Figure 7:
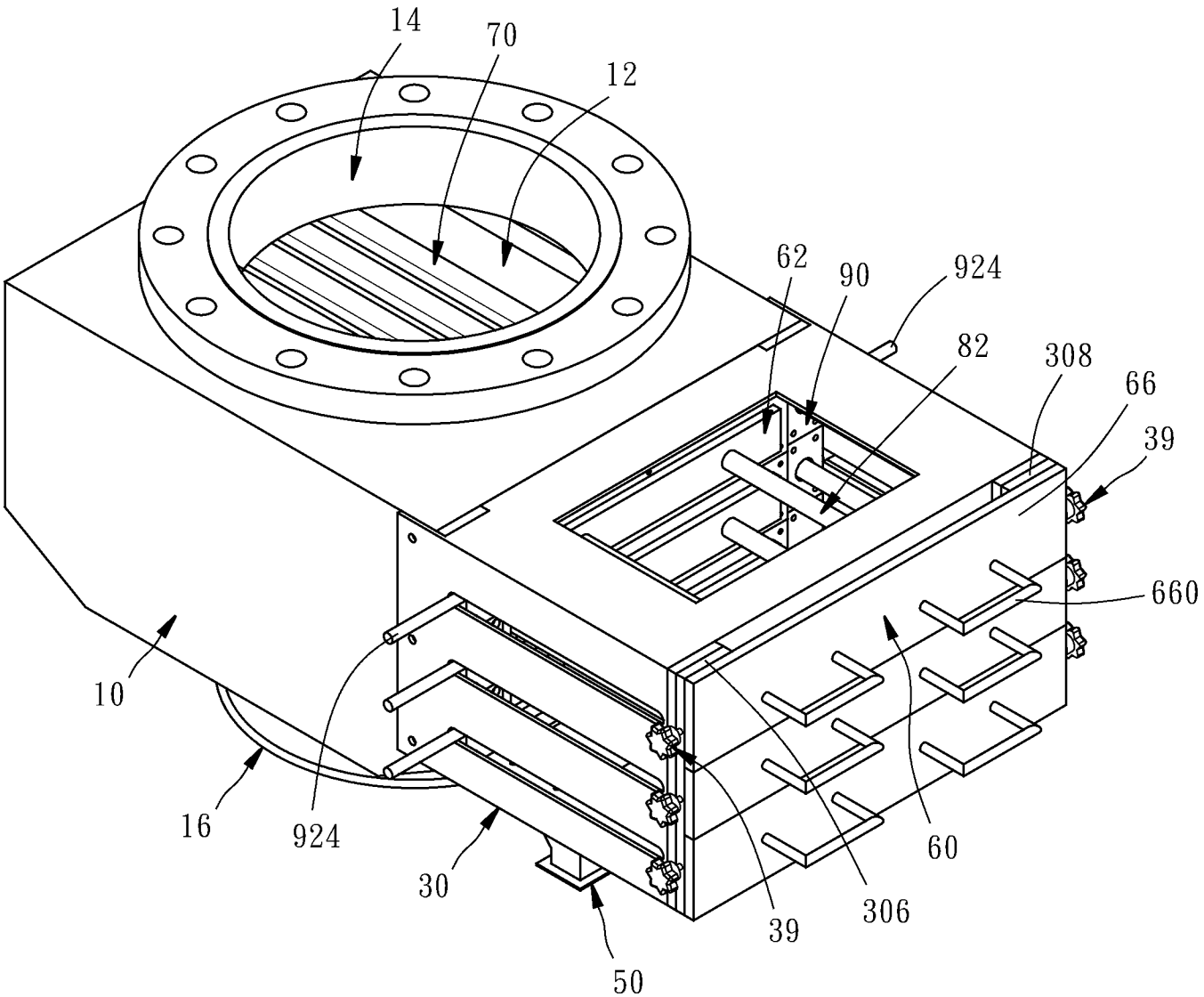
FIG. 7 is a perspective view of the first preferred embodiment of the present invention, showing the drawer units thereof located in a retracted position.
Figure 8:
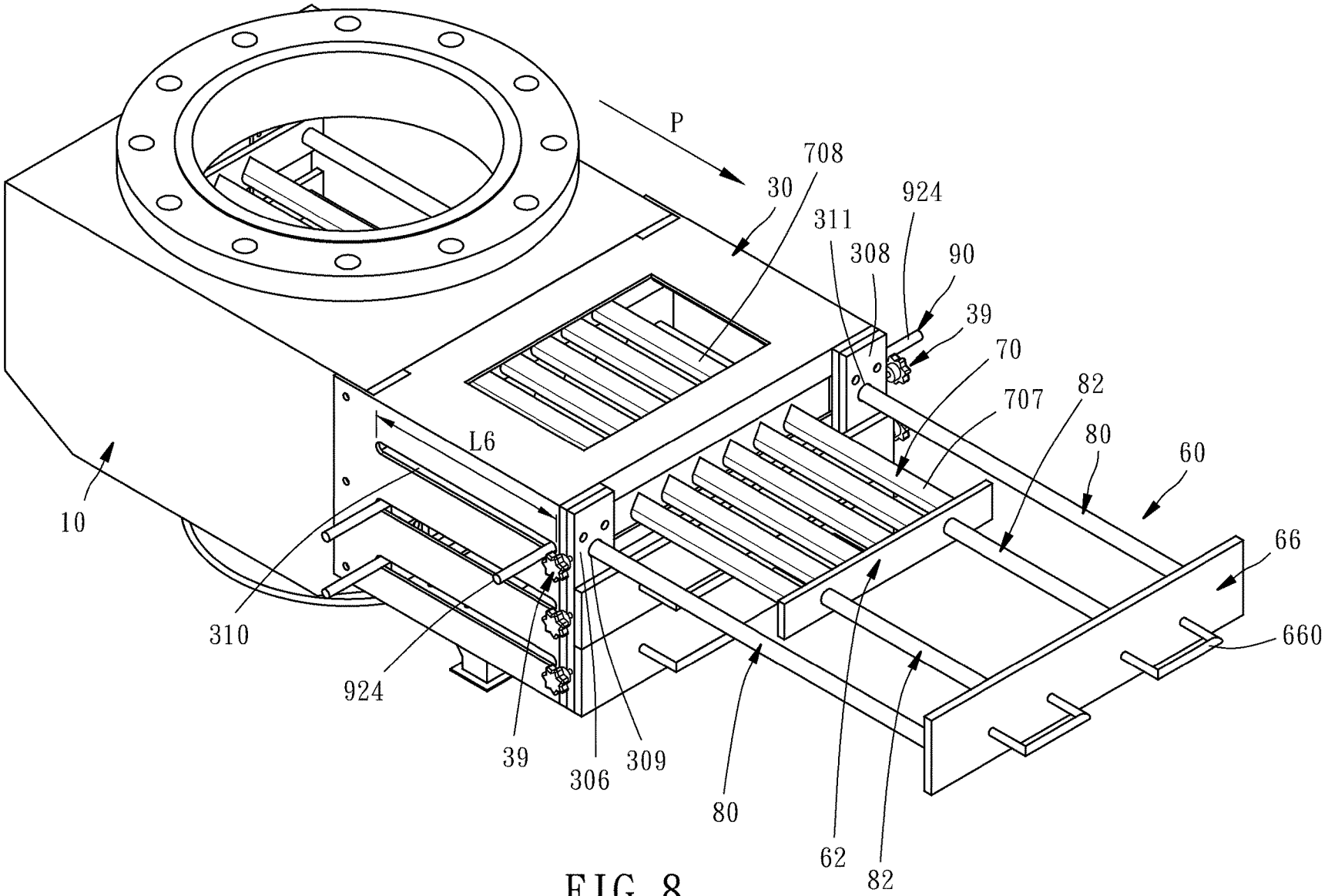
FIG. 8 is a perspective view of the first preferred embodiment of the present invention, showing an upper drawer unit thereof located in an extended position.

In combination, as shown in FIGS. 1, 7 and 8, each of the drawer units 60 is combined with the primary and secondary housings 10 and 30 in the same way. Accordingly, each of the drawer units 60 will be described herein with reference to the upper drawer unit 60. In this embodiment, each of the guiding rods 80 of the frame 61 passes through a first guiding bore 113 and 115 disposed on each of the first supporting plates 106, 108 and a second guiding bore 309 and 311 disposed on each of the second supporting plates 306, 308 so that the frame 61 is supported thereby and movable along the moving path P. For enabling each guiding rod 80 to slide smoothly on each of the guiding bores, a self-lubricating bearing can be respectively installed therein. Furthermore, each of the two side walls 302 and 304 of the secondary housing 30 comprises three guiding slots 310 that are spaced apart from each other and have a sixth length L6 approximately equal to the second length L2 in the direction of moving path P. The scraping assembly 90 further comprises a pair of guiding bars 924 disposed on each side of the base plate 92 and extending outwardly from each of the guiding slots 310 so that the scraping assembly 90 is movable in a first distance defined by the sixth length L6 of the guiding slots 310. The face plate 66 includes a pair of handlebars 660 for the operator to hold when moving the drawer unit 60.

When the frame 61 is combined with the primary housing 10, the rear plate 64 is received in the first internal space 12 and the stopping plate 110 has a plurality of guiding bores 112 so that when the frame 61 is pulled out to be located in the extended position, the rear plate 64 is stopped by the stopping plate 110 to limit the frame 61 in that position and allow the magnetic members 70 passing through the guiding bores 112 to enter the second internal space 32. And when the frame 61 is pulled out to be located in the extended position, the scraping assembly 90 is moved synchronously to lean against the front ends of the guiding slots 310 by the guiding bars 924 thereof. In such a state, as shown in FIG. 8, for the fourth length L3 of the magnetic member 70 is longer than the second length L2 of the secondary housing 30, a front part 707 of the magnetic member 70 is located outside the secondary housing 30 and a rear part 708 of the magnetic member 70 including the non-magnetic section 74 is located inside the secondary housing 30. Preferably, the length of the front part 707 is longer than that of the rear part 708.

Moreover, in this embodiment, as shown in FIG. 7, the first length L1 of the first internal space 12 is longer than the fourth length L3 of the magnetic member 70 and the front plate 62 is disposed outside the first internal space 12 so that when being pushed into until the front plate 62 is stopped by the stopping plate 110, the frame 61 is located in the retracted position, all the magnetic members 70 are received in the first internal space 12 for contacting with the stream of raw materials, and the face plate 66 is lean against the second supporting plates 306, 308 of the secondary housing 30. At the same time, the scraping assembly 90 is moved synchronously to lean against the rear ends of the guiding slots 310 by the guiding bars 924. In addition, the secondary housing 30 may further comprise a plurality of mechanical latches 39 disposed on the second side walls 302 and 304 of the secondary housing 30 respectively for selectively locking the drawer units 60 in a closed position with respect to the secondary housing 30.

Figure 9:
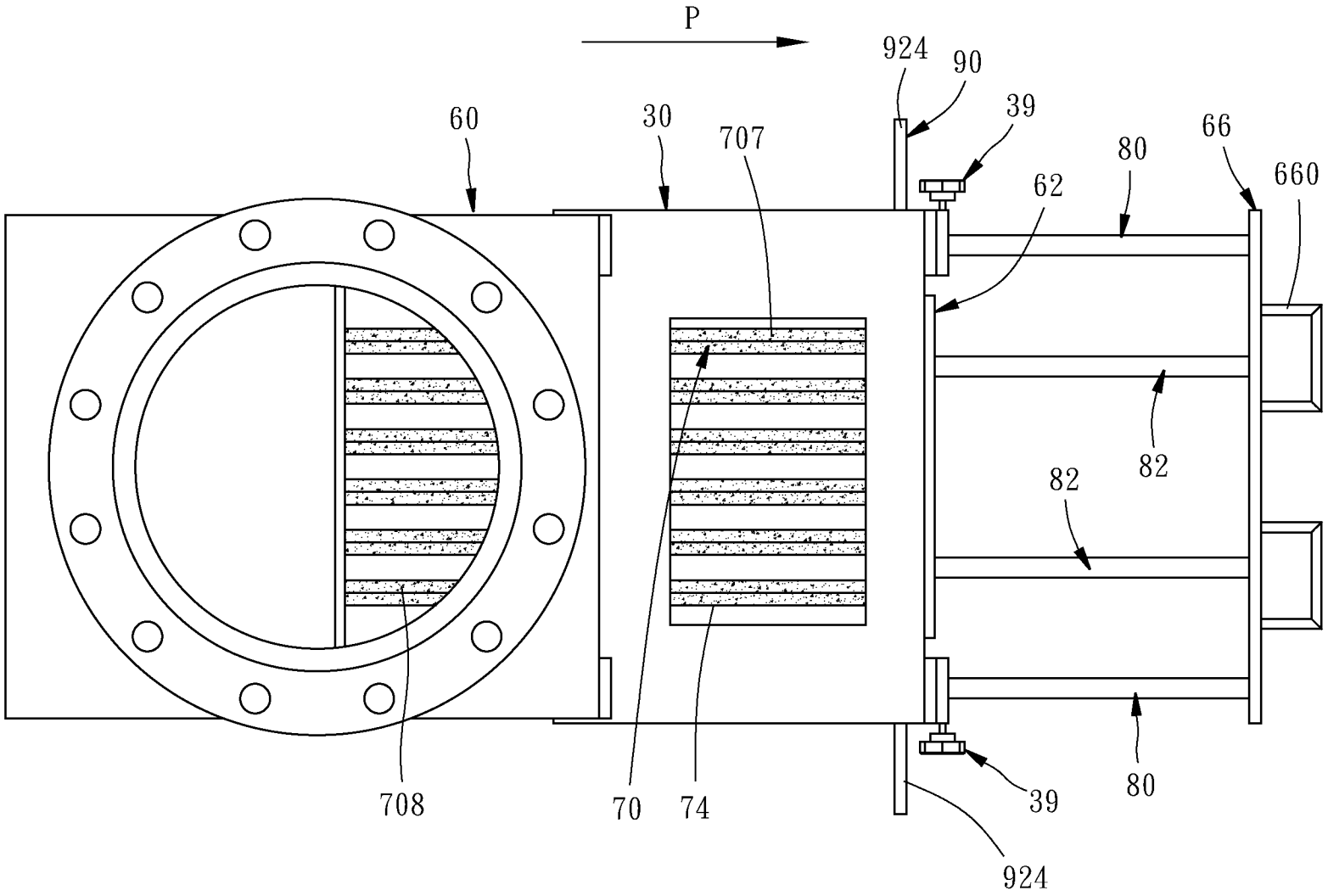
FIG. 9 is a top side view of the first preferred embodiment, showing the upper drawer unit thereof located in a passaged position.
Figure 10:
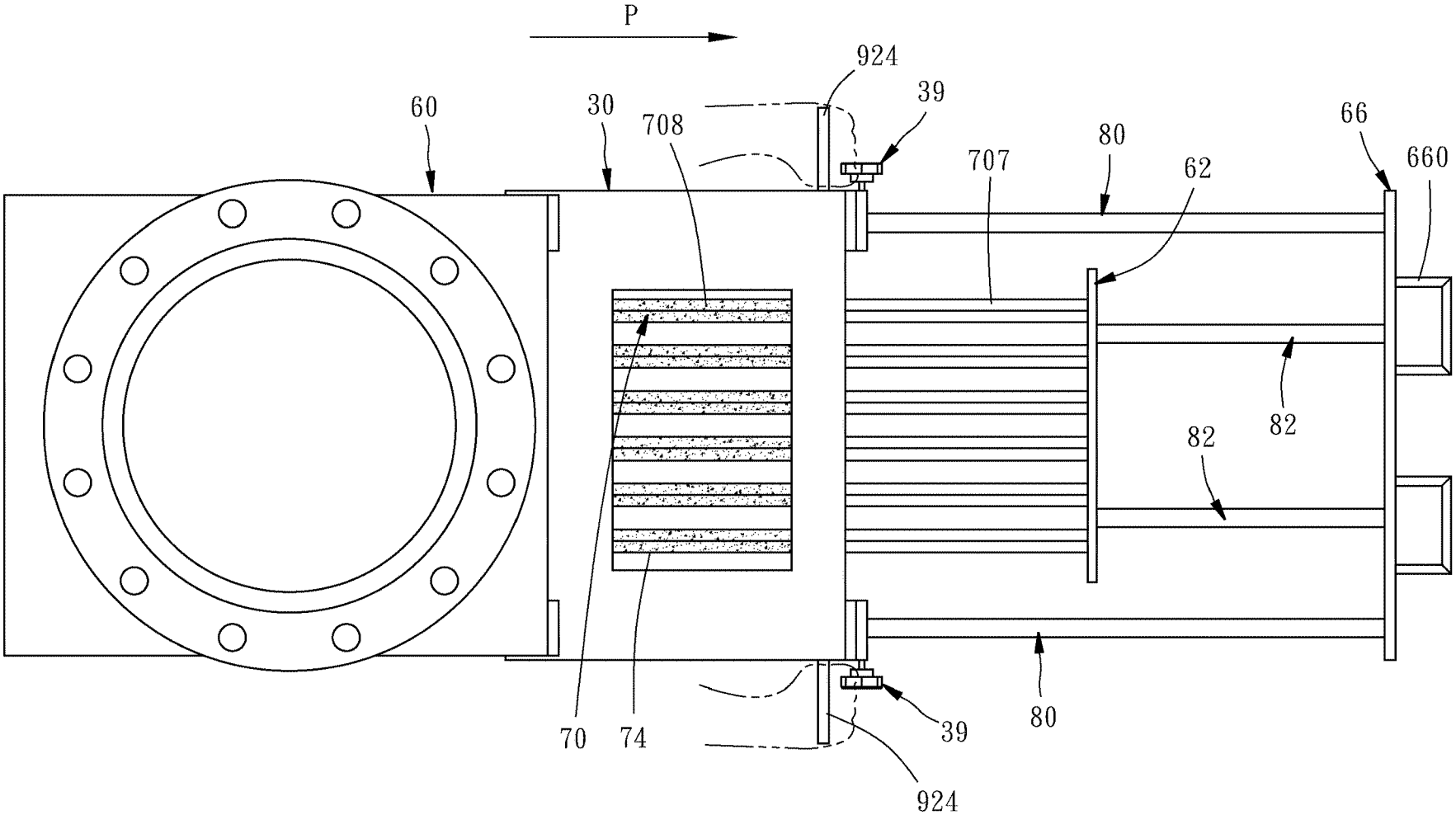
FIG. 10 is a top side view of the first preferred embodiment, showing an upper drawer unit located in the extended position and the scraping assembly located in one side of the secondary housing.
Figure 11:
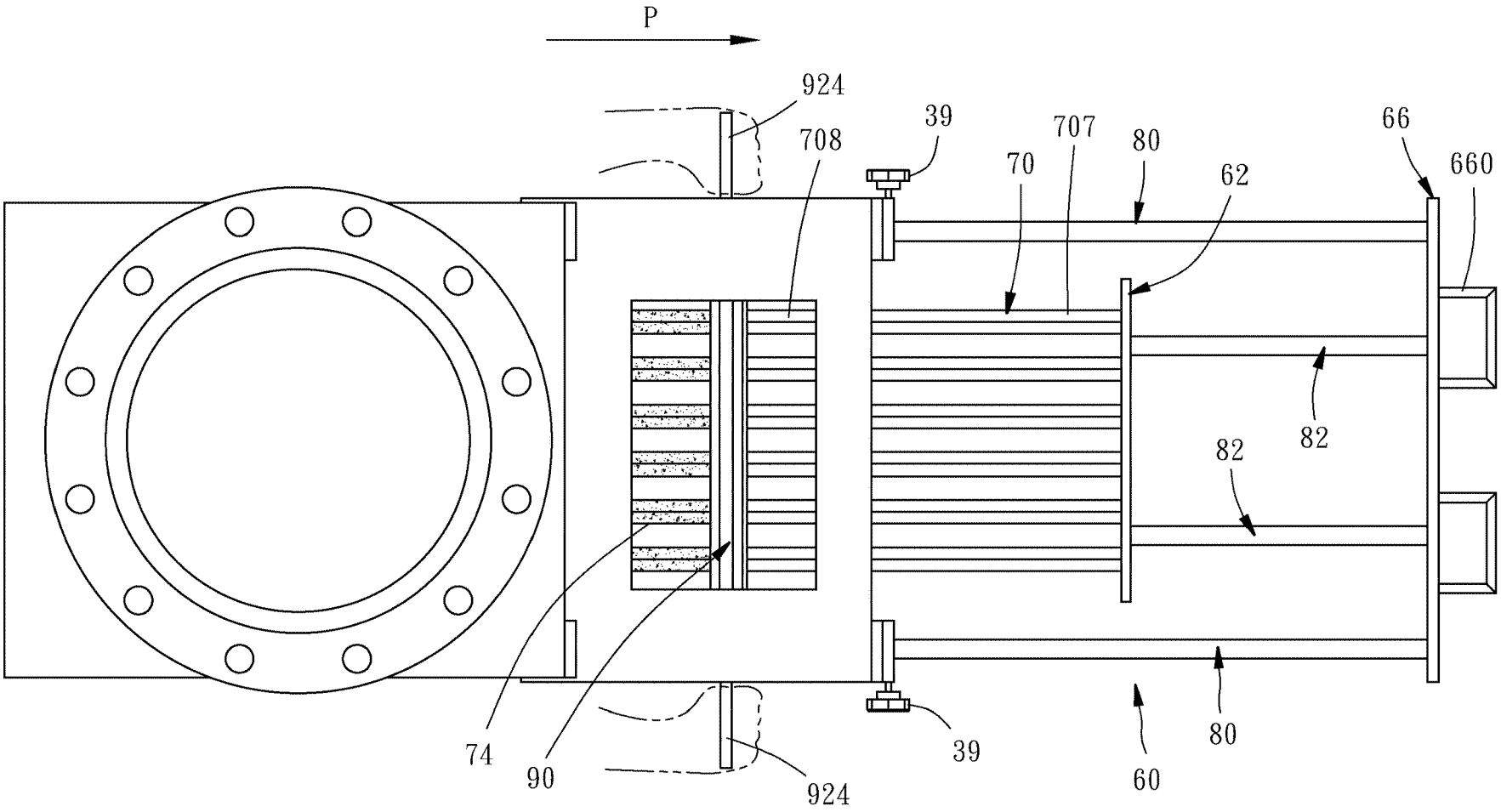
FIGS. 11 and 12 are a top side view of the first preferred embodiment, showing the operator holding the guiding bars to move the scraping assembly in a direction opposite to the moving path P to scrape tramp metals attached on the magnetic section of each of the magnetic members to the non-magnetic section thereof to discharge tramp metals.
Figure 12:
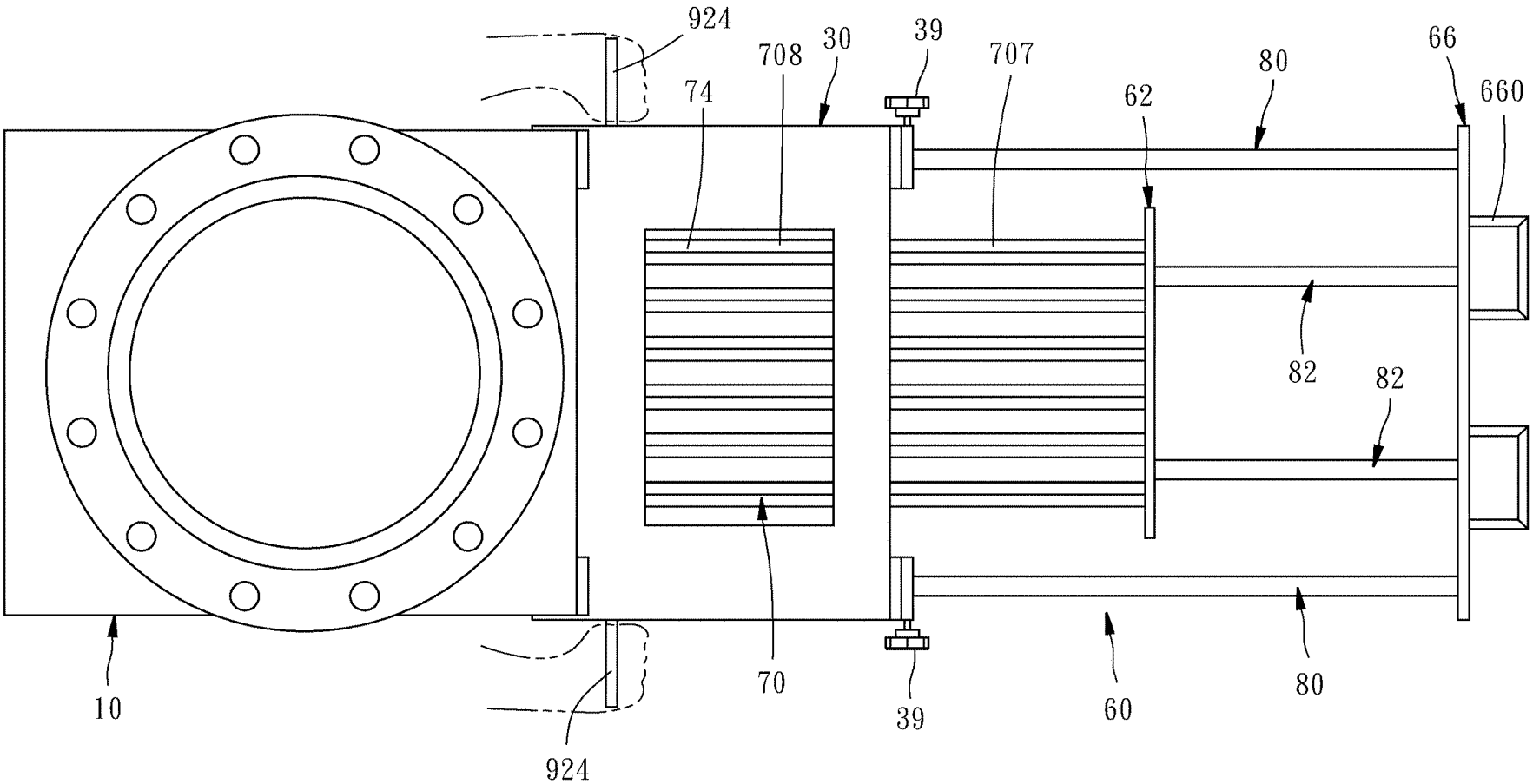

Hereinafter described is the operation of the tramp metal removing device 100 and, thereby, the advantages of it will be more clearly understood. As shown in FIGS. 7 and 9, all the drawer units 60 are firstly positioned in the retracted position. In this state, the magnetic members 70 are received in the first internal space 12 for contacting with the stream of raw materials introduced into the first inter space 12 from the upper inlet 14, and allowed to pass through the first inter space 12. As the stream of raw materials passes through the primary housing 10, tramp metals contained therein are attached to the outer peripheral surface of the magnetic section 72 of each magnetic member 70. And at this time, all the drawer units 60 are locked in this position by the mechanical latches 39. As tramp metals attached to the magnetic members 70 reach a predetermined amount, as shown in FIG. 7, the operator firstly unlocks the mechanical latches 39 and then holds the handlebars 660 to pull the upper frame 61 outwardly along the moving path P in a first distance approximately equal to the second length L2. At the same time, the scraping assembly 90 is moved synchronously in the first distance to lean against the front ends of the guiding slots 310 by the guiding bars 924, as shown in FIG. 9. In this state, the frame 61 and the scraping assembly 90 are both located at the passaged position. And when the frame 61 is pulled out continuously along the moving path P in a second distance to be located in the extended position, as shown in FIG. 10, tramp metals attached to the front part 707 of the magnetic member 70 are removed by the scraping assembly 90 and gathered on the rear part 708 of the magnetic member 70 received in the secondary housing 30 for performing the first stage of scraping. Then, the operator re-locks the mechanical latches 39 and holds the guiding bars 924 to move the scraping assembly 90 in a direction opposite to the moving path P until the guiding bars 924 lean against the rear ends of the guiding slots 310, as shown in FIGS. 11 and 12, such that tramp metals attached to the rear part 708 of the magnetic members 70 are removed by the scraping assembly 90 toward the non-magnetic section 74 and automatically separated therefrom for performing the second stage of scraping action. The design mentioned above, by pulling out the frame 61 while performing the first stage of the scraping action, can shorten the distance of the second stage of scraping action. Therefore, compared with the prior art, the present invention is not only labor-saving but also time-saving.

Figure 13:
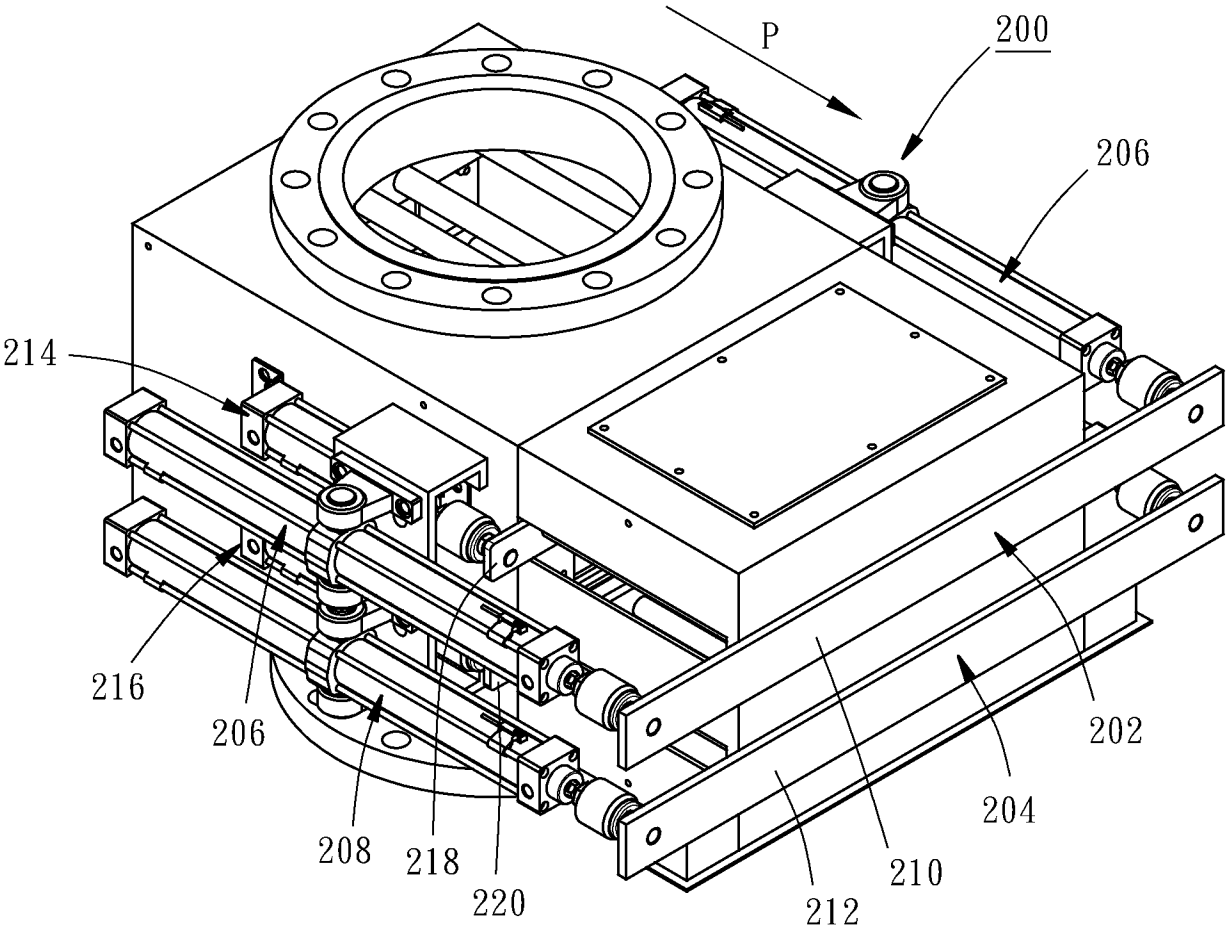
FIG. 13 is a perspective view of a tramp metal removing device according to a second preferred embodiment of the present invention.

Besides, referring to FIG. 13, it shows a tramp metal removing device 200 configured according to a second preferred embodiment of the present invention. The tramp metal removing device 200 may include two drawer units 202 and 204, two first linear actuators 206 and 208, and two second linear actuators 214 and 216. The first linear actuators 206 and 208 are coupled with the face plates 210 and 212 of the drawer units 202 and 204 respectively. The second linear actuators 214 and 216 are coupled with the scraping assembly 218 and 220 of the drawer units 202 and 204 respectively. When operating, the first linear actuators 206 and the second linear actuator 214 are driven synchronously to move the upper drawer unit 202 from a retracted position along the moving path P to an extended position. And then, only the second linear actuator 214 is driven to move the scraping assembly 218 in a direction opposite to the moving path P to remove tramp metals attached to the magnetic members of the upper drawer unit 202.

What is claimed is:

1. A tramp metal removing device, comprising:

a primary housing including an upper inlet, a bottom outlet opposite the upper inlet and a first internal space disposed between the upper inlet and the bottom outlet to define a product flow path through which a stream of raw materials may pass, a moving path and a first length in the direction of the moving path;

a secondary housing connected to the primary housing, the secondary housing including a second internal space adjacent to the first internal space and a second length in the direction of the moving path, the second length being shorter than the first length;

a plurality of drawer units sequentially stacked on the primary housing and secondary housing, each of the drawer units comprising a frame, a plurality of magnetic members and a scraping assembly, wherein the frame of each of the drawer units includes a front plate, a rear plate opposite one side of the front plate, a face plate opposite the other side of the front plate, a pair of guiding rods, and at least one connecting rod, each of the guiding rods has a fourth length in the direction of the moving path and is coupled between the face and rear plates in a way that one of the guiding rods is coupled at a first end thereof to one side of the face plate and at a second end thereof to one side of the rear plate, and the other one of the guiding rods is coupled at a first end thereof to the other side of the face plate and at a second end thereof to the other side of the rear plate; the at least one connecting rod having a fifth length approximately equal to the second length of the secondary housing is coupled between the front and face plates in a way that a front end thereof is coupled to the front plate and a rear end thereof is coupled to the face plate; the frame is supported by the primary housing and the secondary housing in a way that it is moveable along the moving path between a retracted, passaged and extended positions, the magnetic members are mounted on the frame in parallel to each other and located between the guiding rods, each of the magnetic members includes a non-magnetic rod, a magnetic set and a non-magnetic element, the non-magnetic rod has a third length shorter than the first length and the fourth length but longer than the second length, a proximal end coupled to the front plate and a distal end coupled to the rear plate, the magnetic set is received within the non-magnetic rod and extends from the proximal end of the non-magnetic rod to at least a middle portion of non-magnetic rod for forming the magnetic section, and the non-magnetic element is received within the distal end of the non-magnetic rod and extends from the distal end to abut to the magnetic set for forming the non-magnetic section, each of the magnetic members is secured on the frame in a way that when the frame is located in the retracted position, each of the magnetic members is received in the first internal space and adapted to be in contact with a stream of raw materials;

the primary housing further comprises a first entrance from which each of the drawer units is pushed into or pulled out the first internal space thereof, two first support plates respectively disposed on each side of the first entrance through which the guiding rods of each of the frames pass so that each of the frames can be moved independently along the moving path between the retracted, passaged position and extended positions; a stopping plate disposed on the first entrance, and including a plurality of guiding bores for being passed through by each of the magnetic members respectively such that when each of the frame is located in the retracted position, the front plate of each of the frame is stopped by the stopping plate and received in the second internal space, and when each of the frame is located in the extended position, the rear plate of each of the frame is stopped by the stopping plate and received in the first internal space;

the secondary housing further comprises two side walls defining the second internal space with a second entrance so that each of the drawer units can be pushed into or pulled out the second internal space, and two second support plates respectively disposed on each side of the second entrance through which the guiding rods of each of the frames pass; each of the side walls of the secondary housing comprises a plurality of guiding slots spaced apart from each other and having a predetermined length in the direction of the moving path to define the first distance; and the scraping assembly comprises a base plate coupled with the guiding rods and having a window and two through holes respectively located on each end thereof for being passed through by the guiding rods, a first scraper made of plastic materials with a first hardness and secured on one side of the base plate and having a plurality of first apertures arranged in an area thereof corresponding the window for being passed through by each of the magnetic members respectively in a way that the inner peripheral surface of each of the first apertures is in tight contact with the outer peripheral surface of an associated one of the non-magnetic rods, and a pair of guiding bars, each of the guiding bars connected respectively to each side of the base plate and extending outwardly from each of the guiding slots to which it corresponds so that the scraping assembly can be moved along the guiding slots;

whereby, when the frame is moved from the retracted position to the passaged position, each of the magnetic members is moved a first distance approximately equal to the second length of the secondary housing to be in a state that a portion thereof is received within the first internal space and the other portion thereof is received within the second internal space, and when the frame is moved from the passaged position to the extended position, each of the magnetic members is moved a second distance to be in a state that a portion thereof is positioned outside the second internal space and the other portion thereof including the non-magnetic section is received within the second internal space; the scraping assembly is received in the second internal space and coupled with each of magnetic members to be slidable in a longitudinal direction along each of the magnet members such that when the frame is in the retracted position, the scraping assembly is located at the side of the second internal space that is proximal to the primary housing, when the frame is moved from the retracted position to the passaged position, the scraping assembly is moved synchronously with the frame to be located at the side of the second internal space that is distal from the primary housing for scraping tramp metals attached in a portion of each of the magnetic members to the other portion thereof as the frame is continuously moved in the moving path, and when the frame is moved from the passaged position to the extended position, the scraping assembly is still located in the other side of the second internal space for preparing to scrape tramp metals attached on the magnetic section of each of the magnetic members toward the non-magnetic section thereof to discharge tramp metals as the scraping assembly is moved relative to each of magnetic members in a direction opposite to the moving path.

2. The tramp metal removing device of claim 1, wherein the non-magnetic rod has a drop-shaped cross section.

3. The tramp metal removing device of claim 1, wherein the scraping assembly further comprises a second scraper made of a second material with a second hardness less than the first hardness, secured on the other side of the base plate, and having a plurality of second apertures arranged in an area corresponding the window, each of the second apertures having an inner diameter smaller than the outer diameter of the non-magnetic rod for being passed through by each of the magnetic members in an interference fit manner.

4. The tramp metal removing device of claim 3, wherein the scraping assembly further comprises an emplacing plate having a plurality of third apertures opposite to the second apertures for being passed through by each of the magnetic members respectively, and secured on the base plate in a manner that the second scraper is emplaced between the base plate and the emplacing plate.

5. The tramp metal removing device of claim 1, further comprising a mechanical latch for selectively locking the drawer unit in a closed position with respect to the secondary housing.

6. The tramp metal removing device of claim 1, further comprising a plurality of first and second linear actuators disposed respectively on the primary housing, wherein each of the first linear actuators is coupled with the frame of each of the drawer units and each of the second linear actuators is coupled with each of the scraping assemblies.

* * * * *